US008460044B2

(12) United States Patent
Below et al.

(10) Patent No.: US 8,460,044 B2
(45) Date of Patent: Jun. 11, 2013

(54) SPARK PLUG ELECTRODE AND METHOD OF MAKING

(75) Inventors: Matthew B. Below, Findlay, OH (US); Jeffrey T. Boehler, Holland, OH (US); Jonathon Barricklow, Bowling Green, OH (US)

(73) Assignee: Fram Group IP LLC, Lake Forest, IL (US)

( * ) Notice: Subject to any disclaimer, the term of this patent is extended or adjusted under 35 U.S.C. 154(b) by 398 days.

(21) Appl. No.: 12/692,732

(22) Filed: Jan. 25, 2010

(65) Prior Publication Data

US 2010/0187967 A1 Jul. 29, 2010

Related U.S. Application Data

(60) Provisional application No. 61/146,877, filed on Jan. 23, 2009.

(51) Int. Cl.
*H01T 21/02* (2006.01)

(52) U.S. Cl.
USPC ..... 445/7; 313/141; 123/169 EL

(58) Field of Classification Search
USPC ..... 313/118–145; 123/169 R, 169 EL, 123/32, 41, 310; 445/7
See application file for complete search history.

(56) References Cited

U.S. PATENT DOCUMENTS

| | | | | |
|---|---|---|---|---|
| 4,786,267 | A * | 11/1988 | Toya et al. | 445/7 |
| 4,810,220 | A | 3/1989 | Moore | |
| RE35,429 | E * | 1/1997 | Kondo | 313/141 |
| 6,334,800 | B1 * | 1/2002 | Nishikawa et al. | 445/7 |
| 6,791,246 | B2 * | 9/2004 | Niessner | 313/141 |
| 2002/0171346 | A1 * | 11/2002 | Ulm et al. | 313/141 |
| 2008/0174221 | A1 * | 7/2008 | Tinwell | 313/141 |
| 2008/0174222 | A1 * | 7/2008 | Kowalski et al. | 313/141 |
| 2010/0264803 | A1 * | 10/2010 | Nunome et al. | 313/141 |

* cited by examiner

*Primary Examiner* — Anne Hines
*Assistant Examiner* — Jose M Diaz
(74) *Attorney, Agent, or Firm* — Barnes & Thornburg LLP

(57) ABSTRACT

A method of manufacturing a center electrode for a spark plug, the method including the steps of: resistance welding a sphere of a noble metal to a center electrode of a spark plug to provide a center electrode with an electrode tip that has a tip portion of a first configuration, the first configuration having a first height and a first width; and shaping the tip portion after the sphere is welded to the center electrode by a process wherein the tip portion will have a second configuration having a second height and a second width, the second height being greater than the first height and the second width being less than the first width wherein a peripheral edge of the noble metal is flush with a peripheral edge of the material it is secured to.

15 Claims, 4 Drawing Sheets

SPARK PLUG ELECTRODE AND METHOD OF MAKING

CROSS REFERENCE TO RELATED APPLICATIONS

This application claims the benefit of U.S. Provisional Patent Application Ser. No. 61/146,877, filed Jan. 23, 2009, the contents of which are incorporated herein by reference thereto.

BACKGROUND

Exemplary embodiments of the present invention relate to spark plug electrodes and methods of making the same.

Spark plugs are used in internal combustion engines to ignite the fuel in the combustion chamber. Hence, the electrodes of a spark plug are subject to intense heat and an extremely corrosive atmosphere. To provide some degree of longevity for the spark plug, the side wire and center electrodes have been made from good conductive materials that are resistant to corrosion for example platinum or platinum alloys.

However platinum electrodes are expensive to manufacture due to the inherent costs of the platinum or platinum alloys.

Accordingly, it is desirable to form a precious metal electrode tip in a cost efficient manner.

SUMMARY OF THE INVENTION

In accordance with an exemplary embodiment of the present invention a method of manufacturing a center electrode for a spark plug is provided, the method including: resistance welding a noble metal to a center electrode of a spark plug to provide a center electrode with an electrode tip that has a tip portion of a first configuration, the tip portion having a first height and a first width; and shaping the tip portion after the sphere is welded to the center electrode by a process wherein the tip portion will have a second height and a second width, the second height being greater than the first height and the second width being less than the first width, wherein a peripheral edge of the noble metal is flush with a peripheral edge of the material it is secured to.

In another exemplary embodiment, a spark plug having a center electrode is provided, the center electrode being formed by the method including the steps of resistance welding a sphere of noble metal to a center electrode of a spark plug to provide a center electrode with an electrode tip that has a tip portion of a first configuration, the tip portion having a first height and a first width; and shaping the tip portion after the sphere is welded to the center electrode by a process wherein the tip portion will have a second height and a second width, the second height being greater than the first height and the second width being less than the first width, wherein a peripheral edge of the noble metal is flush with a peripheral edge of the material it is secured to.

DETAILED DESCRIPTION OF EXEMPLARY EMBODIMENTS

Exemplary embodiments of the present invention relate to methods of making spark plug electrodes and spark plugs with electrodes formed in accordance with an exemplary embodiment of the present invention.

Figure 1:
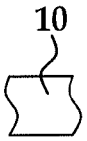
FIG. 1 is a cylindrical blank cut from a source of inconel wire.

Reference is made to U.S. Pat. No. 4,810,220, the contents of which are incorporated herein by reference thereto. In this patent a method of manufacturing an electrode for a spark plug is illustrated by the various steps set forth in the drawings (FIG. 1-FIG. 15) of which FIG. 1 illustrates a piece of corrosion resistant metal wire having a dimension of about 0.139× 0.2" which is cut from a spool or rod. The preferred metal wire is a corrosion resistant alloy of nickel containing iron and chromium generally known as inconel or nickel alloys. One such material is Inconel 600. Of course, other nickel alloys and dimensions thereof are contemplated to be within the scope of exemplary embodiments of the present invention.

Before placing a piece of inconel wire 10 into a die it should be coated with a standard cold heading lubricant. Such a lubricant is an oil with extreme pressure additives; sulphur, chlorine and neutral animal fat. It is most often a combination of sulphurized fat and a chlorine additive and is available from a good number of lubricant manufacturers. Lubrication is vital in cold heading to reduce die wear, promote good finishes and eliminate galling, scratching and seizing of the work piece by preventing pickups by the die. During the cold heading operation, the sulphur and chlorine components of the lubricant form ferrous sulphides and chlorides which prevent welding of the die to the work piece and act in the same way as a solid lubricant. A non-limiting example of one such lubricating oil is TUF-DRAW 21334 made by the Franklin Oil Corporation of Ohio.

Figure 2:
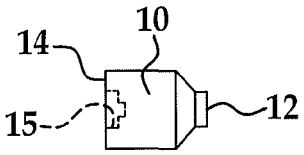
FIG. 2 is a view of the cylindrical blank of FIG. 1 which has been extruded to define a tip on a first end and an indentation on a second end.
Figure 3:
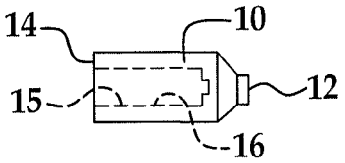
FIG. 3 is a view of the blank of FIG. 2 wherein the indentation has been elongated by a further extrusion step.
Figure 4:
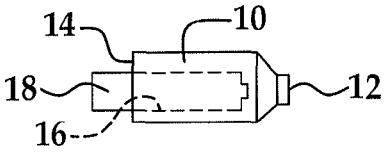
FIG. 4 is a view of the blank of FIG. 3 with a copper core inserted into the cup defined by the indentation.
Figure 5:
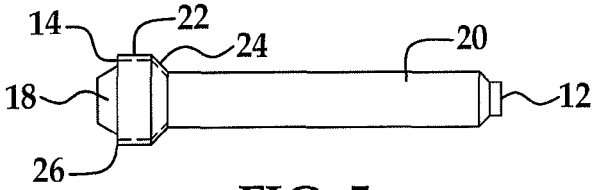
FIG. 5 is a view of the blank of FIG. 4 which has been extruded to a final desired length to define a center wire.
Figure 6:
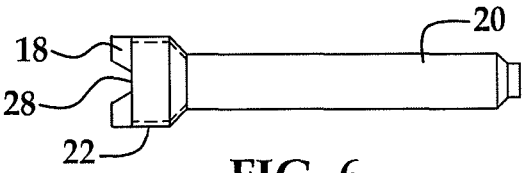
FIG. 6 is a view of the center wire of FIG. 5 with cross slot formed in the copper core center.

After the wire 10 is cut into a blank as shown in FIG. 1 and lubricated, it is taken to a first die where the first 12 and second 14 ends are squared to define flat surfaces and end 12 is extruded to produce a tip while an indentation 15 is formed in end 14 as shown in FIG. 2. The cylindrical blank 10 is transported to a second die and further extruded to develop a center bore 16 that extends from indentation 15, as shown in FIG. 3. After a copper core 18 is inserted in bore 16, as shown in FIG. 4, the cylindrical blank 10 is transported to a third die and further extruded to a predetermined length as shown in FIG. 5 to produce a center wire 20. Center wire 20 has a shoulder 22 with a tapered surface 24 and a lip 26.

The center wire 20 is removed from the third die and carried to a station where cross 28 is formed into the copper core 18 to complete its manufacture. A center wire 20 manufactured according to the procedure set forth above could be inserted into the porcelain or ceramic body of a spark plug.

Figure 7:
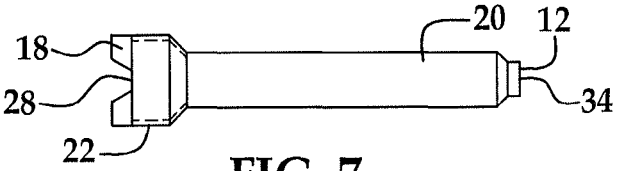
FIG. 7 is a view of the center wire of FIG. 6 showing the axial center having the tip of the first end.
Figure 8:
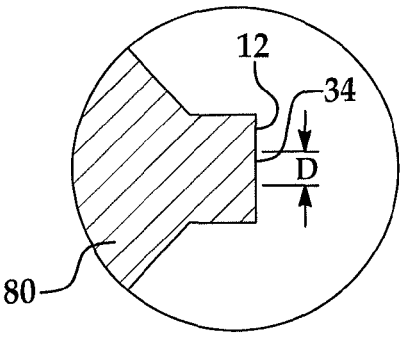
FIG. 8 is an enlarged sectional view of the tip on the first end of the center wire in FIG. 7.

The center wire 20 is further developed according to the disclosure of this invention by being transported to a fourth die where the axial center 34 of the tip of the first end 12 is identified to produce a center wire 80 as shown in FIGS. 7 and 8. The axial center 34 in normally a mark but could be an indentation. If an indentation is made on the tip it should not exceed between 25 to 40 percent of the diameter "D" of a sphere of platinum 36 which is metallurgically bonded thereto at another station. Such indentation in addition to help aligning the sphere 36 in substantially the axial center of the center wire 80 may provide aid in providing a larger initial surface area for the flow of current to produce the metallurgical bond.

Such indentation in the center wire 80 could be placed on the tip during any of the expansion steps illustrated in FIGS. 2-6.

Prior to the center wire 80 being transported to the station illustrated by FIG. 9, at least the tip on the first end 12 of the center wire 80 is passed through a cleaning station where oil and any oxides thereon are removed which may effect the later development of a metallurgical bond with the platinum sphere 36.

The platinum sphere 36 which is located in head 38 of a welding apparatus has a diameter 0.030 inches (0.0076 cm). The diameter of the sphere 36 of platinum could conceivable be as small as 0.020 inches (0.051 cm) and as large as 0.050 inches (0.127 cm). Of course, other dimensions and/or ranges are considered to be within the scope of embodiments of the invention. However, with the market price of platinum and the least amount of platinum needed to protect the underlying inconel should be selected.

Figure 9:
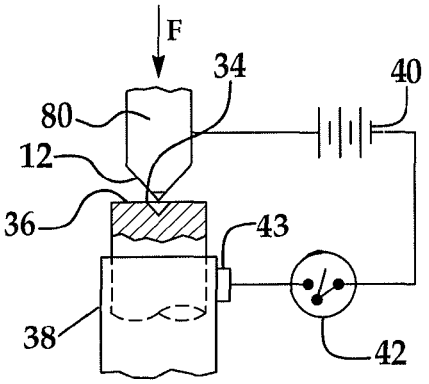
FIG. 9 is a sectional view of the center wire of FIG. 7 located in a fixture with the axial center on the tip positioned over a sphere of platinum.
Figure 10:
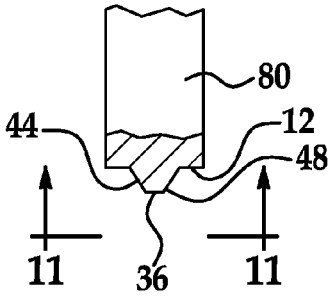
FIG. 10 is an enlarged view of the junction of the center wire and sphere of FIG. 9 after electrical current and pressure have caused the center wire to melt and flow over the sphere.

The welder located at the station illustrated in FIG. 9, is state of the art sold by The Taylor-Winfield Corporation of Warren, Ohio and identified as Model No. EBA-1 1/2 of course, other equivalent devices are contemplated.

The axial center 34 of tip on the end 12 of center electrode 80 is located over the sphere 36 of platinum. Switch 42 allows electrical current from a source 40 to flow to contact 43, through the sphere 36 of platinum into the center electrode 80 of inconel and back to ground. As electrical current is flowing a compressive force "F" is placed on the center electrode 80 to form a mechanical connection at the axial center 34 and sphere 36.

From experiments the following welding parameters were found to be satisfactory: the compressive "F" on the center electrode 80 could vary from about 9-25 pounds while the electrical current could vary from 500 to 1500 amps of course, other suitable ranges are contemplated.

Figure 11:
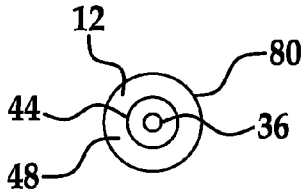
FIG. 11 is a view taken along line 11-11 of FIG. 10.

The flow of electrical current across the mechanical connection or junction creates thermal energy sufficient to melt the inconel adjacent the axial center 34. Gravity causes the melted inconel to flow and form a ring 44 around the sphere 36 in a manner illustrated in FIG. 10. When at least one-half of the sphere is coated with inconel, the switch 42 interrupts the flow of electrical current from source 40 and the force "F" is removed. The flow of inconel around the sphere forms a metallurgical bond that is equal to approximately one-half the total surface area of the sphere 36. As best seen in FIG. 11, the sphere 36 is located in the axial center of the tip of end 12 of electrode 80. For some applications, the protrusion of the sphere 36 above the tip of end 12 will be acceptable, however, for most general applications, it is desirable to increase the surface area of protection over a larger area of the tip. As a result, the electrode 80 is thereafter transported to a station where a compressive force is applied to flatten the sphere 36 in a manner illustrated by the sectional view in FIG. 12 and end view in FIG. 13.

Figure 12:
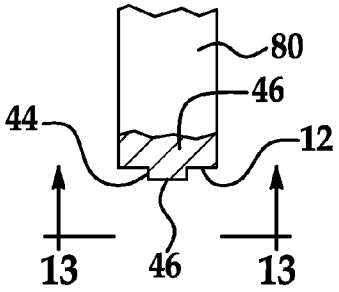
FIG. 12 is a sectional view of the center electrode with the sphere of platinum flatten to cover a larger area of the tip of the first end.
Figure 13:
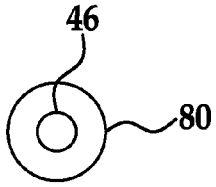
FIG. 13 is a view taken along line 13-13 of FIG. 12.

As can be seen in FIG. 12, the force applied to flatten the platinum, about 500 pounds (1100 kg), causes the ring 44 to fold back on itself. Disc 46 over approximately one-half the diameter of the tip on end 12 while a dome 45 completely fills an indentation formed along the axial center of the center electrode 80.

Figure 15:
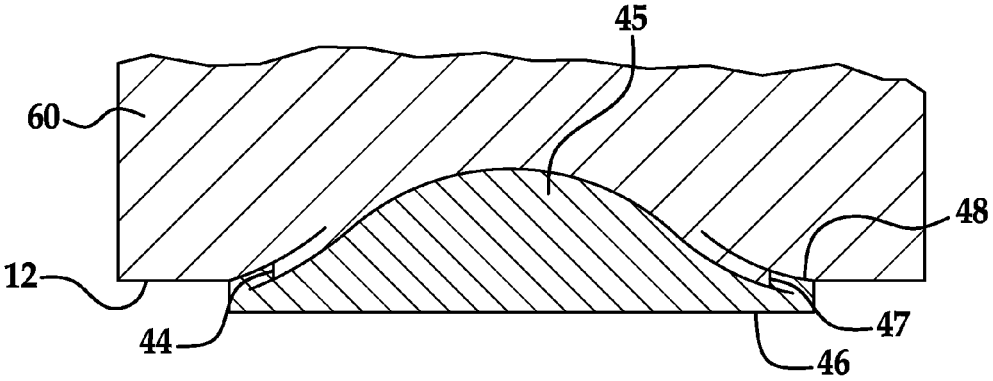
FIG. 15 is a sectional view of a center electrode with a sphere of platinum metallurgically bonded thereto.

FIG. 15 is a schematic illustration of a sectional view of an actual center wire electrode 80 with a flatten disc of platinum 46. The diameter of the disc 46 extended past the edge of tip 48 to provide protection for ring 44. Although, the ring of inconel 44 has been compressed into the end 12, the platinum disc 46 forms a uniform surface on the tip for the flow of electrical current. The thickness of the platinum at the edge 47 was measured as 0.002-0.006 inches while the diameter of the disc was 0.05-0.06 inches. Thus, it should be evident that a sphere of platinum can provide approximately twice the surface area coverage as its initial diameter.

Figure 17:
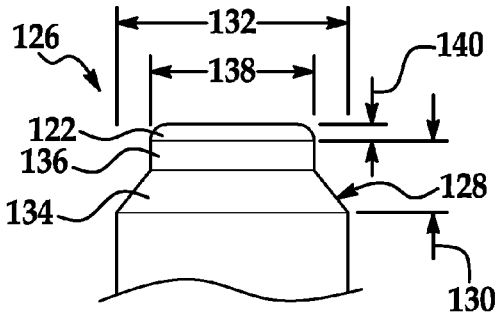
FIG. 17 illustrates a first configuration of a center electrode in accordance with an alternative embodiment prior to transformation to a second configuration in accordance with an exemplary embodiment of the present invention.

In one non-limiting exemplary embodiment of the present invention, the force and process applied to the platinum sphere is such that the diameter is large enough that the edge of the platinum or noble metal is flush with the edge of the material it is secured to after this flush arrangement is further machined or transformed during another process (See for example FIG. 17).

It being understood that the aforementioned dimensions, ranges, values, material descriptions with regard to FIGS. 1-15 are provided as examples and exemplary embodiments of the present invention are not to be limited to the specific dimensions, ranges, values and material descriptions provided herein.

In accordance with an exemplary embodiment of the present invention the center electrode wire with the platinum sphere welded thereto using the teachings of U.S. Pat. No. 4,810,220 is flattened and machined to have an improved configuration.

Figure 16A:
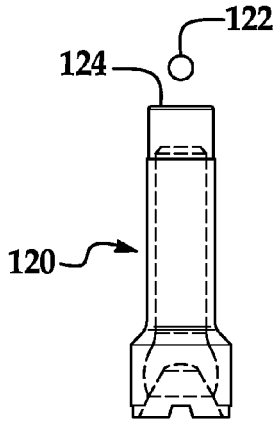
FIGS. 16A-16E illustrate a center electrode formed in accordance with an exemplary embodiment of the present invention.
Figure 16B:
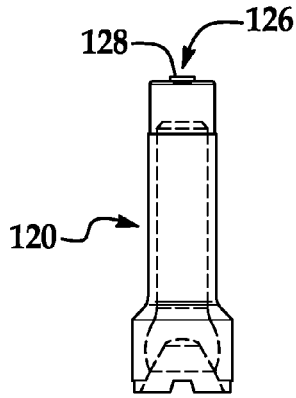
Figure 16C:
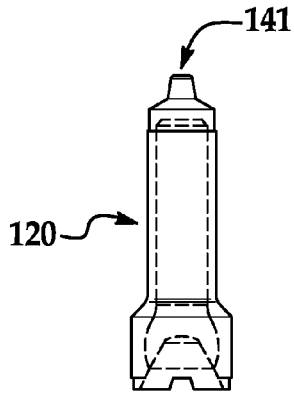

For example and referring now to FIGS. 16A-16C an exemplary embodiment of electrode forming in accordance with the present invention is illustrated, here the center electrode wire 120 has an electrode tip or sphere 122 secured to an end portion 124 of the center electrode by the aforementioned process or equivalents thereof. Once secured thereto, a die is brought into engagement with the sphere and the sphere 122 is flattened to establish a first tip configuration 126 comprising the electrode tip and a first portion 128 of the end portion 124 of the center electrode. Thus, the first tip configuration comprises a portion of the end portion of the center electrode and the electrode tip.

Thereafter, the first tip configuration is machined and/or formed to provide a second tip configuration 141 wherein the first portion 128 of the end portion 124 of the center electrode is extended in length and reduced in diameter and peripheral edges of the electrode tip are flush with edges of the surface of the first portion the electrode tip is secured to. During use of the electrode tip in a spark plug, this flush engagement prevents undercutting and/or erosion of the surface the electrode tip is secured to. Accordingly, the noble metal tip is less likely to be disengaged from the surface it is secured to and in essence, a noble fine wire tip is provided with a minimal amount of noble materials being used.

Figure 16D:
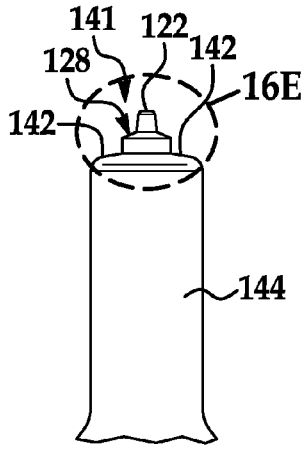
Figure 16E:
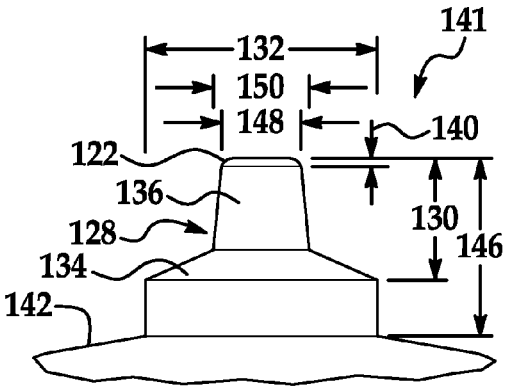

As illustrated in at least FIGS. 16C-E, the second tip configuration 141 has a second height and a second width, wherein the first portion comprises a first truncated section 134 and a second section 136 extending therefrom. Although one specific configuration is illustrated it is of course, understood that numerous other types of configurations may be provided by the aforementioned securement processes. In addition, the extended tip 122 will have a second width 148 and a second height 140, the second width being less than a first width of the electrode tip and the second height being greater than the first height of the electrode tip. In one embodiment, the second section is slightly truncated from a dimension or diameter 150 to a dimension or diameter 148, which is flush with the edges of the electrode tip as discussed above. The second section resembles a fine wire shaft with a noble metal electrode tip. First portion 128 also includes the truncated portion 134.

FIGS. 16D and 16E also illustrate the center electrode in an insulator 144 after being manipulated into the second tip configuration wherein electrode tip 122 extends from an end 142 of the ceramic insulator.

Referring now to FIG. 17 and in an alternative embodiment, the electrode tip is resistance welded and then flattened upon a slightly truncated end portion of a preformed center electrode. Here, the electrode tip 122 will have a first width 138 and a first height 140 and the second section will also have a first width 138 and extend from a truncated section 134 having a first width 132. In this embodiment, the noble metal sphere is first resistance welded to the end portion of the center electrode that is already slightly preformed such that the electrode tip is flush with the edges of the material it is secured to or the flattening process or step creates an electrode tip that is flush with the edges of the material it is secured to. In this embodiment, the machining process from the first tip configuration 126 of FIG. 17 to the second tip configuration of FIG. 16C causes less wear and tear to be provided to the tools of the machining process since less machining of materials is required. As used herein machining process contemplates a lathe or other equivalent machine wherein the center electrode is placed in a machine for rotation about an axis and tools with edges contact a surface of the spinning electrode to cut or reshape desired portions of the center electrode. Accordingly, the center electrode in one embodiment is turned on a lathe, wherein the turning process referred to is a material-removing method for machining the center electrode or center electrode surface in which the surface is rotated and a lathe chisel or tool that cuts or machines the work piece operates in an axial or radial advancing motion with respect to a rotational axis of the piece being turned.

Other machining processes include grinding, turning, or milling wherein the tip is machined in a material-removing manner. Also, honing, lapping, or polishing can also be used.

Figure 18:
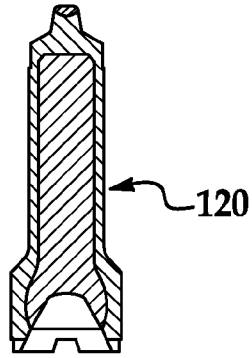
FIG. 18 is a cross-sectional view of a center electrode formed in accordance with an exemplary embodiment of the present invention.

As discussed above, the first tip configuration 126 is machined by a lathe or any other suitable device to change the first tip configuration 126 (e.g., center electrode wire with the platinum or platinum alloy electrode tip) to a second tip configuration 141. The change from the first configuration to the second configuration or from the configuration illustrated in FIG. 16B to that illustrated in FIG. 16C, 16D or 16E or the configuration of FIG. 17 to the configuration of FIG. 16C, 16D or 16E provides a noble metal center electrode without using a large amount of noble metal material for the electrode tip since only a portion is secured to the end. In addition, the end portion of the center electrode now extends further from an end 142 of a ceramic insulator 144 when the center electrode is inserted into the ceramic insulator. Also, the peripheral edges of the electrode tip are flush with the second section of the portion of the center electrode. The aforementioned extended distance is illustrated by dimension 146 and the diameter or width of the end portion of the center electrode comprising the electrode tip and second section 136 of the center electrode is reduced to dimension 148 while a height of 130 and 140 of the electrode tip and the first portion is increased. FIG. 18 illustrates a cross sectional view of the center electrode in FIG. 16C.

In one embodiment and in order to change the first tip configuration to the second tip configuration, the center electrode is rotated in a lathe or equivalent device and a blade or other equivalent device shapes the electrode (e.g., from the configuration illustrated in FIG. 16B to that of FIG. 16C or the configuration of FIG. 17 to the configuration of FIG. 16C). In another embodiment, a cold forming process may be used.

Although platinum or platinum alloys are mentioned for use as the electrode tip it is also contemplated that other "wear resistant" materials or precious metals or alloys may be employed non-limiting examples also include iridium, iridium alloys, etc. Still other non-limiting examples include those of U.S. Patent Publication No. 2008-0018217, the contents of which are incorporated herein by reference thereto.

Figure 19:
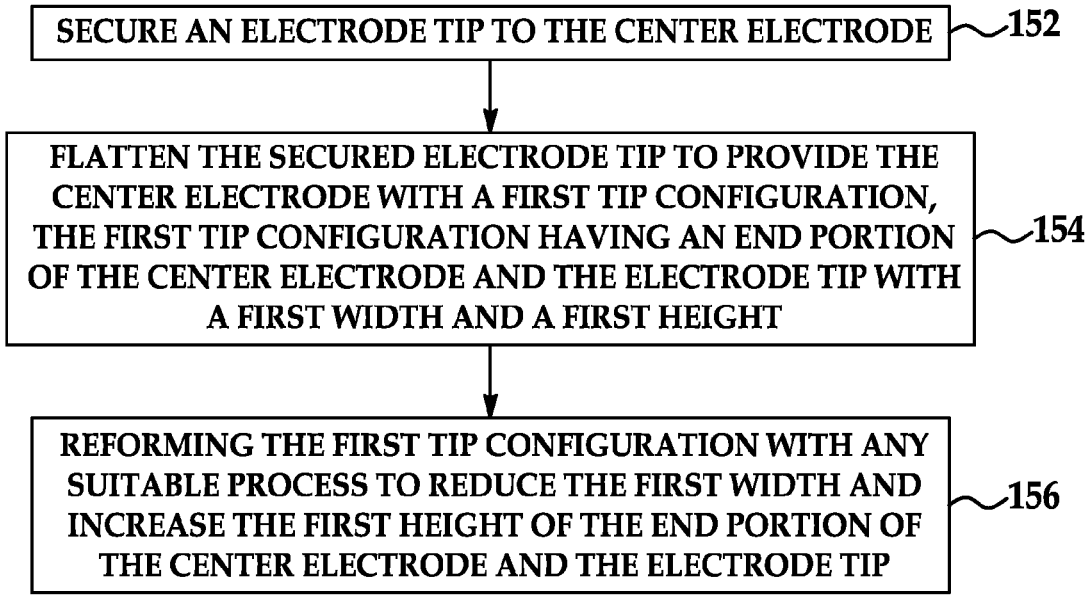
FIG. 19 illustrates a method of an exemplary embodiment of the present invention.

A non-limiting example of methods of shaping the center electrode is illustrated at least in FIG. 19. For example in a first step 152 an electrode tip is secured to the center electrode to provide a center electrode with a noble metal tip electrode. Then in a second step 154 the electrode tip is flattened to provide a first tip configuration, the first tip configuration having an end portion of the center electrode and the electrode tip each with a first width and a first height. In this second step the electrode tip portion may or may not be flush with the peripheral edges of the material it is secured to. Then in a third step 154 reforming of the first tip configuration occurs with any suitable process to reduce the first width and increase the first height of the end portion of the center electrode and the electrode tip. The third step then provides a second tip configuration, wherein the edges of the electrode tip are flush with the peripheral edges of the material it is secured to.

By shaping the end of the center electrode by flattening and machining the end portion of the center electrode to provide an electrode with a noble metal tip secured to an end portion and flush with the sides of the end of the center electrode after the securement of the electrode tip by for example, resistance welding the electrode tip thereto, there is surprisingly minimal loss of the noble metals of the electrode tip during the aforementioned processes.

Accordingly, the machining process to change the electrode configuration from the first tip configuration 126 to the second tip configuration 141 (e.g., FIG. 16B to 16C or 17 to 16B), an extended electrode tip is provided wherein the periphery of the electrode tip is flush with an end portion of the center electrode the electrode tip is secured to. In addition, the machining process limits the amount of noble metal lost from the electrode tip during the reshaping from the first tip configuration to the second tip configuration. This reshaping method limits the amount of noble metal loss and surprisingly most of the platinum, platinum alloy or noble metal of the electrode tip secured to the center wire and is retained even though the electrode tip is formed flush with the periphery of the end of the center electrode and thus a cost efficient means of providing a center electrode of the configuration illustrated in FIGS. 16C, 16D and 16E is provided.

FIG. 16C also illustrates the change in the center electrode from the resistance weld and flattened configuration of FIG. 17 to that of FIG. 16C due to the forming and/or machining processes of exemplary embodiments of the present invention.

Afterwards, the center electrode wire is inserted into a ceramic insulator of (FIGS. 16D and 16E) and then the center electrode and ceramic insulator is fixed in a metal shell of a spark plug.

In an alternative embodiment a rivet or other configuration is secured to the center wire. Thereafter, the rivet is then manipulated or machined to the configuration illustrated in at least FIGS. 16C and 16D. An example of a rivet is found in U.S. Pat. No. 5,456,624 the contents of which are incorporated herein by reference thereto.

Figure 14:
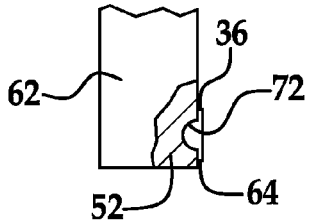
FIG. 14 is a sectional view of a side electrode.
Figure 20:
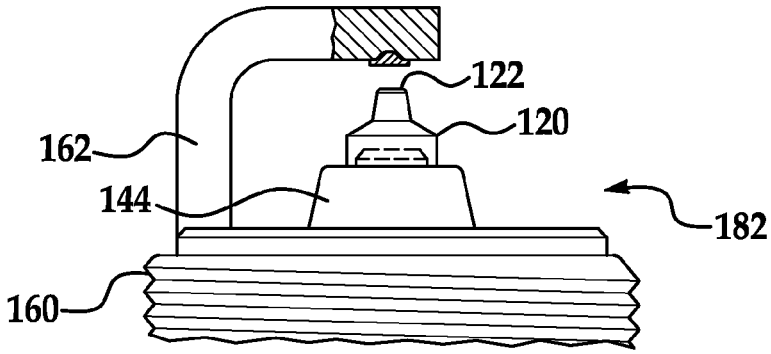
FIG. 20 illustrates a spark plug formed in accordance with an exemplary embodiment of the present invention.

Referring now to FIG. 20, a spark plug formed by exemplary embodiments of the present invention may also have a side wire electrode 162 also shown as 62 in FIG. 14 wherein the same process of welding a sphere of platinum to an inconel member of the side wire is employed. The side wire 162 is welded to a metal shell of a spark plug 160. The generation of thermal energy causes a ring of inconel 64 (FIG. 14) to flow around the sphere 36 and define a metallurgical bond. When at least one-half of the sphere 36 was coated with inconel, the current was terminated and the compressive force removed. Thereafter, a die was brought into engagement with the sphere and flattened the sphere 36 to establish disc 72 and dome 72 which fills indentation 52. Thereafter, the center wire of an exemplary embodiment is located in a ceramic member located in a metal shell to complete the manufacture of spark plug. Thus, the side wire electrode can be used in a spark plug having the center electrode of FIGS. 16A-18A.

Although resistance welding techniques are disclosed herein other welding techniques are contemplated to be within the scope of the various embodiments of the present invention, one non-limiting alternative welding process is a laser welding process.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A method of manufacturing a center electrode for a spark plug, the method comprising the steps of:

providing a preformed center electrode having a first center electrode portion with a first width and a truncated end extending from the first center electrode portion and forming a second center electrode portion with a second width that is less than the first width; and resistance welding a sphere of a noble metal to the truncated end of the center electrode to provide a noble metal tip, wherein the sphere is resistance welded to the truncated end of the center electrode such that peripheral edges of the noble metal of the sphere are flush with peripheral edges of the truncated end of the center electrode.

2. The method of claim 1, wherein the noble metal is a platinum or platinum alloy.

3. The method of claim 2, wherein the material the platinum or platinum alloy is secured to is a nickel alloy.

4. The method of claim 1, wherein the resistance welding step further includes the step of flattening the sphere of noble metal such that peripheral edges of the noble metal are flush with peripheral edges of the truncated end of the center electrode.

5. The method of claim 4, wherein the shaping step is performed by a machining process.

6. The method of claim 1, further including the step of shaping the second center electrode portion after the noble metal is welded to the second center electrode portion by a process wherein a third width of the second center electrode portion after the shaping step is less than the second width of the second center electrode portion prior to the shaping step.

7. The method of claim 1, wherein the amount of noble metal utilized is minimized and the amount of noble metal removed is minimized.

8. A method of manufacturing a center electrode for a spark plug, the method comprising the steps of:

forming a center electrode having a first center electrode portion with a first width and a truncated end extending from the first center electrode portion and forming a second center electrode portion with a second width that is less than the first width;

resistance welding a sphere of a noble metal to the truncated end of the center electrode to provide a noble metal tip, wherein the sphere is resistance welded to the truncated end of the center electrode such that peripheral edges of the noble metal of the sphere are flush with peripheral edges of the truncated end of the center electrode and the center electrode comprises a material different from the noble metal; and shaping the second center electrode portion after the noble metal is welded to the second center electrode portion such that a third width of the second center electrode portion after the shaping step is less than the second width of the second center electrode portion prior to the shaping step.

9. The method of claim 8, wherein the noble metal is a platinum or platinum alloy.

10. The method of claim 9, wherein the material of the platinum or platinum alloy is secured to is a nickel alloy.

11. The method of claim 8, wherein the shaping step is performed by a machining process.

12. A method of manufacturing a center electrode for a spark plug, the method comprising the steps of:

providing a preformed center electrode having a first center electrode portion with a first width and a truncated end extending from the first center electrode portion and forming a second center electrode portion with a second width that is less than the first width;

resistance welding a sphere of a noble metal to the truncated end of the center electrode to provide a noble metal tip;

flattening the sphere of noble metal such that peripheral edges of the noble metal are flush with peripheral edges of the truncated end of the center electrode; and shaping the second center electrode portion after the noble metal is welded to the second center electrode portion such that a third width of the second center electrode portion after the shaping step is less than the second width of the second center electrode portion prior to the shaping step.

13. The method of claim 12, wherein the noble metal is a platinum or platinum alloy.

14. The method of claim 13, wherein the material of the platinum or platinum alloy is secured to is a nickel alloy.

15. The method of claim 12, wherein the shaping step is performed by a machining process.

* * * * *